US011044972B2

(12) United States Patent
Hermanson

(10) Patent No.: US 11,044,972 B2
(45) Date of Patent: Jun. 29, 2021

(54) UMBRELLA HAVING AN EXTERIOR STRETCHER FRAME

(71) Applicant: MR. CHRISTMAS INCORPORATED, New York, NY (US)

(72) Inventor: Terry Hermanson, New York, NY (US)

(73) Assignee: Mr. Christmas Incorporated, New York, NY (US)

( * ) Notice: Subject to any disclaimer, the term of this patent is extended or adjusted under 35 U.S.C. 154(b) by 0 days.

(21) Appl. No.: 16/654,849

(22) Filed: Oct. 16, 2019

(65) Prior Publication Data

US 2020/0113298 A1 Apr. 16, 2020

Related U.S. Application Data

(60) Provisional application No. 62/746,205, filed on Oct. 16, 2018.

(51) Int. Cl.
*A45B 25/02* (2006.01)
*A45B 25/22* (2006.01)

(52) U.S. Cl.
CPC ..... *A45B 25/02* (2013.01); *A45B 25/22* (2013.01)

(58) Field of Classification Search
CPC .... A45B 25/16; A45B 2025/105; A45B 25/02
See application file for complete search history.

(56) References Cited

U.S. PATENT DOCUMENTS 1,063,989 A * 6/1913 McCabe ..... A45B 25/143 135/22
1,541,278 A * 6/1925 Pugel ..... A45B 25/16 135/22
3,926,202 A * 12/1975 Uthemann ..... A45B 25/14 135/20.3
4,041,966 A * 8/1977 Sakurai ..... A45B 25/16 135/22
4,240,454 A * 12/1980 Tsai ..... A45B 25/02 135/24
4,421,133 A * 12/1983 Huang ..... A45B 25/143 135/22
4,865,063 A 9/1989 Williams
4,936,332 A * 6/1990 Wu ..... A45B 25/143 135/20.3

(Continued)

FOREIGN PATENT DOCUMENTS

FR 2051680 A1 * 4/1971 ..... A45B 25/02

*Primary Examiner* — Noah Chandler Hawk
(74) *Attorney, Agent, or Firm* — Venable LLP

(57) ABSTRACT

An umbrella includes a shaft, a canopy, and an opening and closing mechanism that moves the canopy between an open state and a closed state. An inner stretcher frame has an inner hub and a plurality of inner stretchers. Each of the plurality of inner stretchers has a proximal end rotatably connected to the inner hub, and a distal end. An outer stretcher frame has an outer hub and a plurality of outer stretchers. Each of the plurality of outer stretchers has a proximal end that is rotatably connected to the outer hub, and a distal end. A plurality of connector assemblies rotatably connect the distal end of each of the plurality of inner stretchers to the distal end of a corresponding one of the plurality of outer stretchers, and retain the outer edge of the canopy.

6 Claims, 7 Drawing Sheets

(56) References Cited

U.S. PATENT DOCUMENTS

| | | | | |
|---|---|---|---|---|
| 5,842,493 | A | 12/1998 | Yakubisin | |
| 6,588,439 | B2 | 7/2003 | Wu | |
| 6,715,504 | B2 | 4/2004 | Chen | |
| 7,415,986 | B2 | 8/2008 | Wu | |
| 7,802,580 | B2 * | 9/2010 | Hermanson | A45B 19/04 135/29 |
| 7,992,581 | B2 * | 8/2011 | Hoogendoorn | A45B 19/00 135/31 |
| 8,567,422 | B2 * | 10/2013 | Lee | A45B 25/14 135/24 |
| 2011/0061694 | A1 * | 3/2011 | Vanderminden, Sr. | A45B 19/00 135/20.3 |

* cited by examiner

UMBRELLA HAVING AN EXTERIOR STRETCHER FRAME

This application claims the benefit of priority to U.S. Provisional Patent Application No. 62/746,205, filed on Oct. 16, 2018, the contents of which is incorporated by reference herein in its entirety.

BACKGROUND OF THE INVENTION

Field of the Invention

The present invention relates to an umbrella. More particularly, the present invention relates to an umbrella having an interior stretcher frame and an exterior stretcher frame.

Description of the Related Art

Umbrellas are designed to protect a user against natural elements, namely precipitation (rain, snow, etc.) and sunlight. Umbrellas are typically comprised of a folding canopy mounted to a frame that includes at least one hub and a plurality of stretchers. In a conventional umbrella, the hub and the stretchers are mounted on a central shaft, the canopy is formed of a fabric or a flexible plastic, and the frame and the shaft are formed of a lightweight metal or a plastic. In addition, the stretchers typically have one or more joints that permit the stretchers to extend (i.e., to open) and to retract (i.e., to close) relative to the hub and the shaft. One joint is provided at an inner end of each stretcher, where the stretcher is connected to the hub, one or more joints may be provided along a length of each stretcher, connecting the canopy to the stretcher at intermediate points, and one joint is provided at an outer end of each stretcher. When the stretchers extend, the stretchers form an arcuate shape, so as to bend downward from the hub, thereby stretching the canopy into a dome-like shape. The joints attached to the inner ends of the stretchers rotate within the hub by an amount that is usually determined by the relative shapes of the joint and the hub. The joints attached to the inner ends of the stretchers may also be spring loaded to rotate in a direction that opens the stretchers relative to the hub and the shaft. When the stretchers retract, the stretchers rotate towards the shaft, and form a straight shape generally parallel to and adjacent to a longitudinal axis of the shaft, thereby folding the canopy.

Umbrellas may be categorized as fully-collapsible umbrellas, in which the shaft is made up of an upper tube that supports the hub, the stretchers, and the canopy, and a lower tube into which the upper tube retracts telescopically, causing the hub to slide down toward the lower tube, and causing the stretchers and the canopy to fold towards the shaft, so that the umbrella is small enough to fit in a handbag or a backpack. The stretchers of a fully-collapsible umbrella have at least one intermediate joint provided between the joint at the inner end of the stretcher and the joint provided at the outer end of the stretcher. The intermediate joint allows the stretcher to fold in half as the upper tube of the shaft retracts into the lower tube. The fully-collapsible umbrella can, therefore, collapse so as to be reduced in overall height when the upper tube retracts into the lower tube and the stretchers fold in half along the shaft. Alternatively, umbrellas may be non-collapsible umbrellas, in which the shaft is formed of an inner tube and an outer tube. The inner tube moves within the outer tube, thereby moving the hub and opening or closing the stretchers and the canopy.

In contrast to fully-collapsible umbrellas, the non-collapsible umbrellas do not reduce in overall height when closed.

Umbrellas may also be categorized as manually-operated umbrellas that require the user to manually open the umbrella by sliding a runner along the shaft, thereby urging the upper tube of a fully-collapsible umbrella, or the inner tube of a non-collapsible umbrella, upward, and urging the joints at the inner ends of the stretchers to rotate so as to extend the stretchers and to open the canopy into the dome-like shape. Umbrellas may also be categorized as spring-loaded automatic umbrellas that require the user to press a button to release a spring that forces the upper tube of a fully-collapsible umbrella, or the inner tube of a non-collapsible umbrella, upward, thereby extending the stretchers and opening the canopy into the dome-like shape.

The frame and the shaft of conventional umbrellas are optimized to be lightweight, so that the user can hold and support the conventional umbrella with one hand. As a result, the stretchers of the frame tend to be relatively thin. In addition, the stretchers are typically provided on a lower side of the canopy, so as to minimize the structure and, therefore, the weight of the frame of the conventional umbrella.

When the conventional umbrella is open, strong wind gusts can strike the lower side of the canopy, causing the stretchers to bend in an upward direction, thereby inverting the dome-like shape of the canopy. This renders the umbrella ineffective for protection from precipitation. Further, such an inversion may cause the stretchers to break and, therefore, the umbrella to become unusable.

The structure of the umbrella of the present invention prevents the above-described problems with conventional umbrellas.

SUMMARY OF THE INVENTION

In one aspect, the present invention provides an umbrella comprising a shaft, a canopy, and an opening and closing mechanism. The shaft has an upper end and a lower end that define a longitudinal shaft axis. The canopy has an inner edge and an outer edge. The inner edge is centrally mounted to the upper end of the shaft. The opening and closing mechanism is provided between the upper end and the lower end of the shaft. The opening and closing mechanism is configured to move the canopy between an open state and a closed state. An inner stretcher frame has an inner hub centrally mounted to the shaft on an inner side of the canopy and a plurality of inner stretchers. Each of the plurality of inner stretchers has a terminal end that is rotatably connected to the inner hub, and a distal end. An outer stretcher frame has an outer hub centrally mounted to the shaft on an outer side of the canopy and a plurality of outer stretchers. Each of the plurality of outer stretchers has a terminal end that is rotatably connected to the outer hub, and a distal end. Additionally, a plurality of connector assemblies rotatably connect the distal end of each of the plurality of inner stretchers to the distal end of a corresponding one of the plurality of outer stretchers, and retain the outer edge of the canopy.

In another aspect, the present invention provides a stretcher frame assembly for stretching a canopy of an umbrella. The assembly comprises an inner stretcher frame and an outer stretcher frame. The inner stretcher frame has an inner hub centrally mountable to a shaft of the umbrella and a plurality of inner stretchers. Each of the plurality of inner stretchers has a terminal end that is rotatably connected to the inner hub, and a distal end. The outer stretcher frame has an outer hub centrally mountable to the shaft and a plurality of outer stretchers. Each of the plurality of outer stretchers has a terminal end that is rotatably connected to the outer hub and a distal end. Additionally, a plurality of connector assemblies rotatably connect the distal end of each of the plurality of inner stretchers to the distal end of a corresponding one of the plurality of outer stretchers and are configured to retain an outer edge of the canopy.

In yet another aspect, the present invention provides an umbrella comprising a shaft, an opening and closing mechanism connected to the shaft, an interior stretcher frame assembly, an exterior stretcher frame assembly, and a canopy. The interior stretcher frame assembly is connected to the shaft and has a plurality of interior stretchers. The exterior stretcher frame assembly is connected to the shaft and has a plurality of exterior stretchers. The canopy is connected to the interior stretcher frame assembly and the exterior stretcher frame assembly. When the opening and closing mechanism opens, the interior stretcher frame assembly and the exterior stretcher frame assembly expand outward from the shaft, thereby opening the canopy, and, when the opening and closing mechanism closes, the interior stretcher frame assembly and the exterior stretcher frame assembly retract inward toward the shaft, thereby closing the canopy.

These and other aspects of the present invention are described in more detail below, with reference to the attached drawings.

DETAILED DESCRIPTION OF THE EMBODIMENTS

Figure 4:
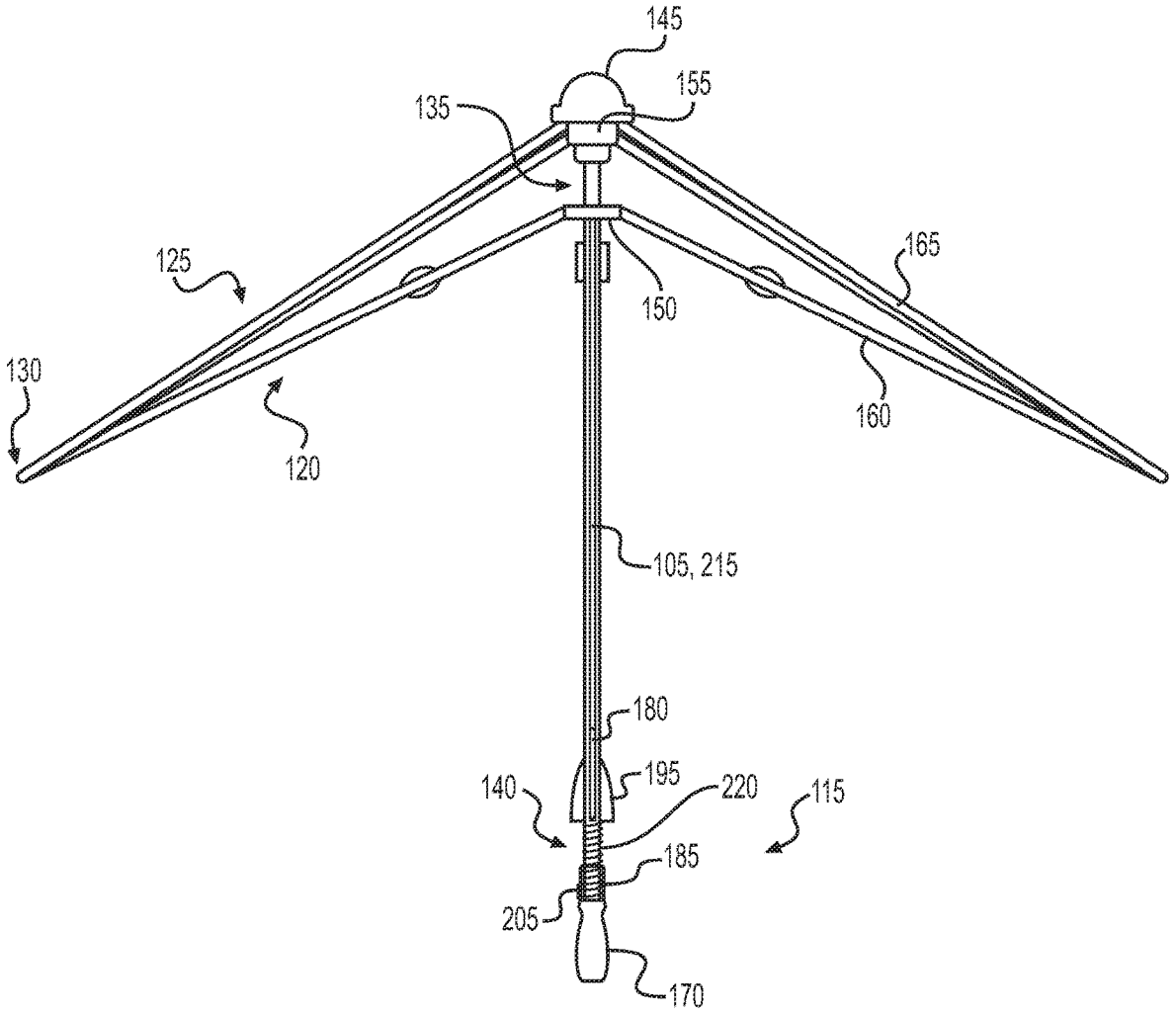
FIG. 4 is a cross-sectional view of the umbrella in one embodiment of the present invention.

In the description of preferred embodiments of the invention, the terms "inner" and "outer" are used in relation to an inner side and an outer side of a canopy of an umbrella, respectively, and are interchangeable with the terms "interior" and "exterior," respectively. The terms "upper" and "lower" are used in relation to an upper end and a lower end of a shaft, respectively, when the umbrella is oriented upright, as shown in FIG. 4. In addition, the terms "distal" and "proximal" are used in relation to the shaft. More specifically, "proximal" refers to a position relatively closer to the shaft, and "distal" refers to a position relatively farther from the shaft.

Figure 1:
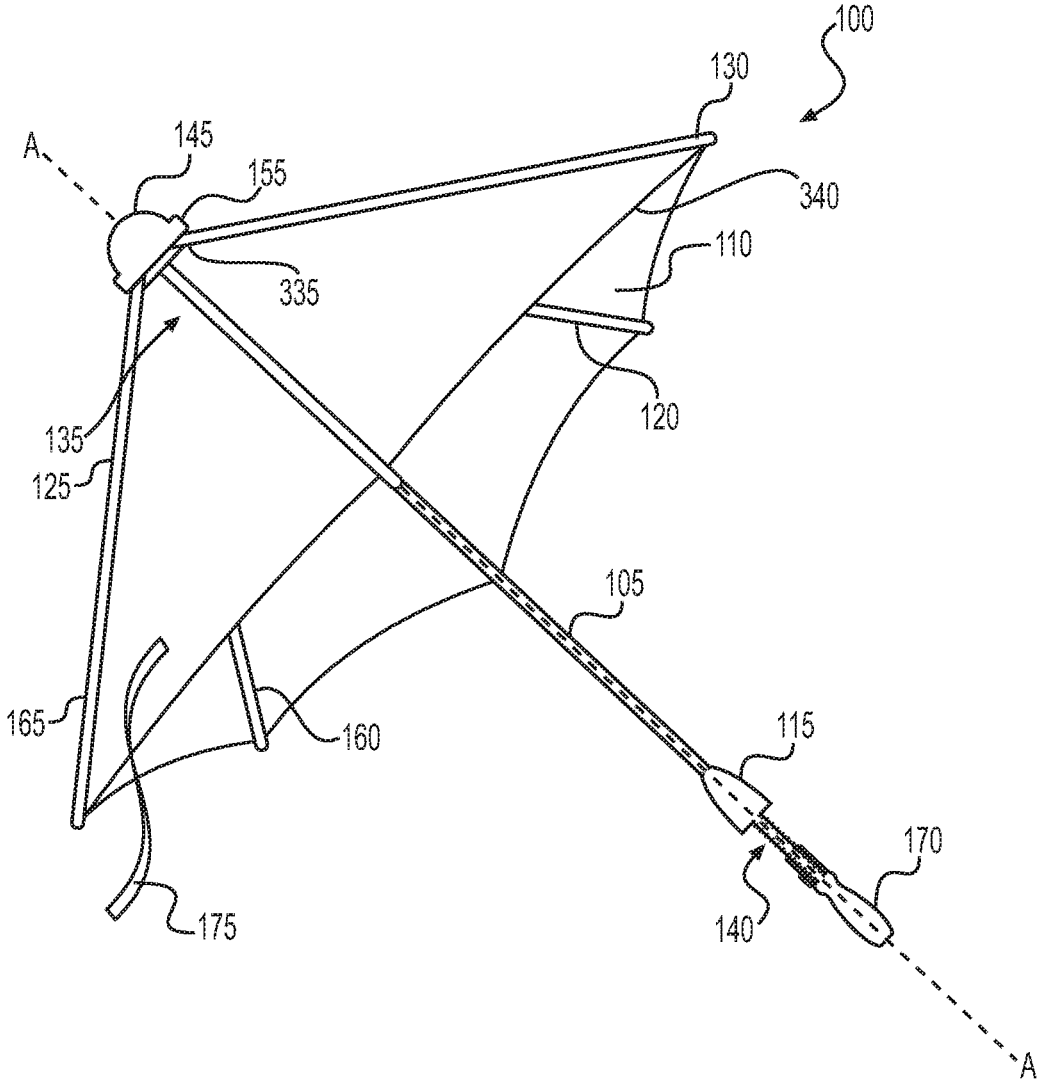
FIG. 1 is an isometric view of an umbrella in one embodiment of the present invention.

As shown in FIG. 1, in one embodiment of the present invention, an umbrella 100 includes a shaft 105, a canopy 110, an opening and closing mechanism 115, an interior stretcher frame 120, an exterior stretcher frame 125, and a plurality of connector assemblies 130. The shaft 105 has an upper end 135 and a lower end 140, and a cap 145 is provided at the upper end 135 of the shaft 105. The upper end 135 and the lower end 140 of the shaft 105 are aligned along a longitudinal axis A-A of the shaft 105. The shaft 105 may be formed of a plastic or a metal. The interior stretcher frame 120 is mounted to the shaft 105 by an interior hub 150 (shown in FIG. 4), and the exterior stretcher frame 125 is mounted to the shaft 105 by an exterior hub 155. The exterior hub 155 is provided movably near the upper end 135 of the shaft 105. The interior hub 150 is provided in a fixed position on the shaft 105 below the exterior hub 155. The cap 145 is attached to the upper end 135 of the shaft 105, above the exterior hub 155. The interior stretcher frame 120 includes the interior hub 150 and a plurality of interior stretchers 160, and the exterior stretcher frame 125 includes the exterior hub 155 and a plurality of exterior stretchers 165. The umbrella also includes a handle 170 at the lower end 140 of the shaft 105, and a strap 175 for securing the umbrella in a closed state. The strap 175 may be secured using hook and loop fasteners, such as Velcro®. Alternatively, two straps (not shown) may be provided on the outer side of the canopy 110 to secure the canopy 110 in the folded state by tying the straps together.

Figure 2:
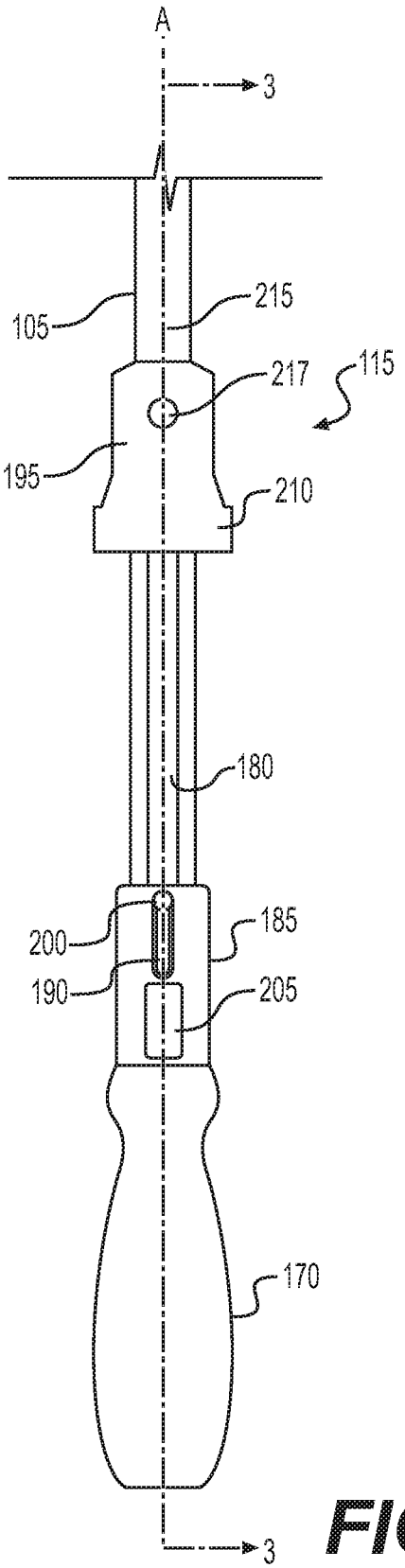
FIG. 2 is a side view of the lower end of a shaft of the umbrella in one embodiment of the present invention.

As shown in FIG. 2, the shaft 105 includes a longitudinal slot 180 provided between the upper end 135 and the lower end 140 of the shaft 105. A connector 185 is provided at the lower end 140 of the shaft 105, and connects the shaft 105 to the handle 170. A hook hole 190 is provided in the connector and adjacent to the longitudinal slot 180. The opening and closing mechanism 115 includes a runner 195, a hook 200, and a button 205. The runner 195 has an inner portion (not shown) that is nested within the shaft 105, and an outer portion that is generally cylindrical and that has a widened rim 210 that is nearest to the lower end 140 of the shaft 105. The runner 195 is mounted to the shaft 105 so as to slide along the shaft 105 and in an upward direction and in a downward direction along the longitudinal axis A-A.

The hook 200 protrudes from the hook hole 190, and is shaped so as to have a protrusion that can catch the widened rim 210 of the runner 195, in order to prevent the runner 195 from moving along the shaft 105. The hook 200 is mounted within the shaft 105, and is connected to the button 205. The hook 200 is mounted within the connector 185 and is biased such that it is normally in a protruded position relative to the shaft, protruding from the hook hole 190. When a user pushes the button 205 inward on the shaft 105, the hook 200 retracts within the hook hole 190, into a retracted position, and releases the widened rim 210 of the runner 195, thereby allowing the runner 195 to move in the upward direction along the shaft 105. When a user releases the button 205, the hook 200 returns to the protruded position. Preferably, the button 205 provides a flat, ergonomic surface that the user can easily and comfortably press to move the hook 200 from the protruded position to the retracted position.

Figure 3:
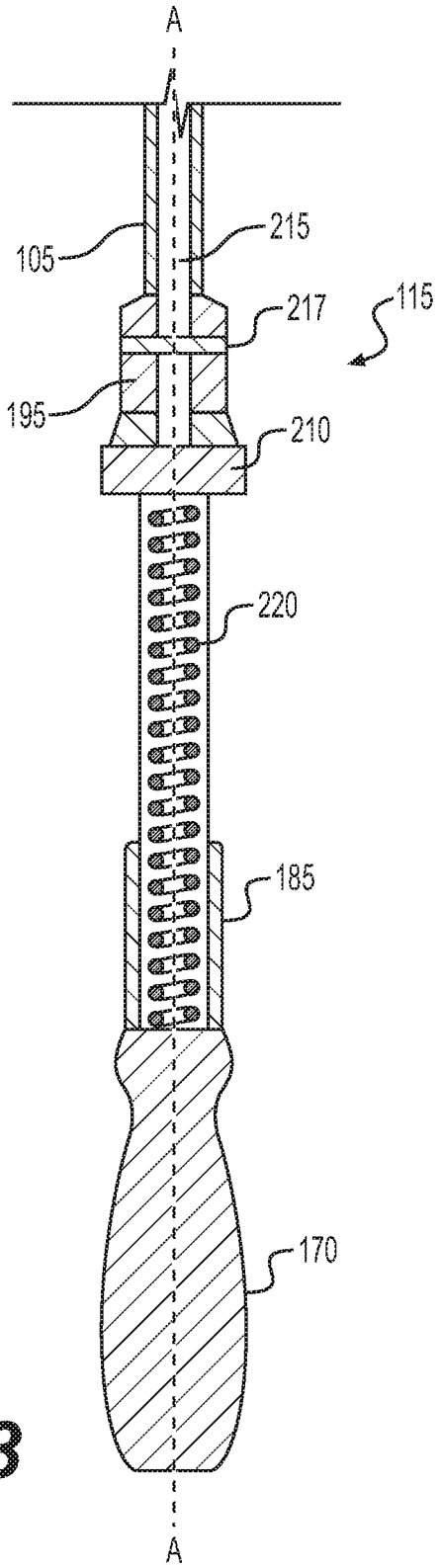
FIG. 3 is a cross-sectional view of the lower end of the shaft shown in FIG. 2, taken along section line 3-3 in FIG. 2.

As shown in FIG. 3, the opening and closing mechanism also includes a rod 215 mounted within the shaft 105 and attached to the runner 195, and a spring 220 that is mounted within the lower end 140 of the shaft 105. The spring 220 of this embodiment is a compression spring that biases the rod 215 toward the upper end 135 of the shaft 105. The spring 220, however, is not so limited and any suitable spring may be used. The rod 215 is connected to the runner 195. Any suitable connection may be used, but in this embodiment, an insert lock pin 217 is inserted through the longitudinal slot 180 to connect the rod 215 to the runner 195. The rod 215 moves telescopically within the shaft 105 along the longitudinal axis A-A. The rod 215 and the runner 195 are preferably formed of a relatively hard plastic material, or a metal.

When the umbrella 100 is closed, the runner 195 is retained by the hook 200, and the spring 220 is compressed by the rod 215 and the runner 195. Because the runner 195 is connected to the rod 215 through the longitudinal slot 180 in the shaft 105, an amount by which the runner 195 slides upward and downward along the shaft 105 is limited to the length of the longitudinal slot 180 as measured along the longitudinal axis A-A. When a user presses the button 205 inward, toward a center of the shaft 105, the hook 200 releases the widened rim 210 of the runner 195, and the spring 220 urges the rod 215 in the upward direction, thereby opening the umbrella 100.

The invention is not limited with respect to the opening and closing mechanism 115 described above, and other opening and closing mechanisms can be used.

With reference to FIG. 4, the interior stretcher frame 120 includes the plurality of interior stretchers 160 and the interior hub 150, and the exterior stretcher frame 125 includes the plurality of exterior stretchers 165 and the exterior hub 155. In the embodiment shown in FIG. 1, the interior stretcher frame 120 includes six interior stretchers 160, and the exterior stretcher frame 125 includes six exterior stretchers 165. The interior stretchers 160 are symmetrically arranged (i.e., they are provided at equal angles relative to adjacent interior stretchers 160) with respect to the interior hub 150. Similarly, the exterior stretchers 165 are symmetrically arranged (i.e., they are provided at equal angles relative to adjacent exterior stretchers 165) with respect to the exterior hub 155. The interior stretcher frame 120 and the exterior stretcher frame 125 are connected to each other at distal ends via the plurality of connector assemblies 130. The interior stretcher frame 120 and the exterior stretcher frame 125 may be formed of a plastic or a metal. More specifically, the interior stretchers 160 of the interior stretcher frame 120 and the exterior stretchers 165 of the exterior stretcher frame 125 may be formed of a relatively flexible plastic, and the interior hub 150 and the exterior hub 155 may be formed of metal. The plurality of connector assemblies 130 may be formed of metal.

Figure 5:
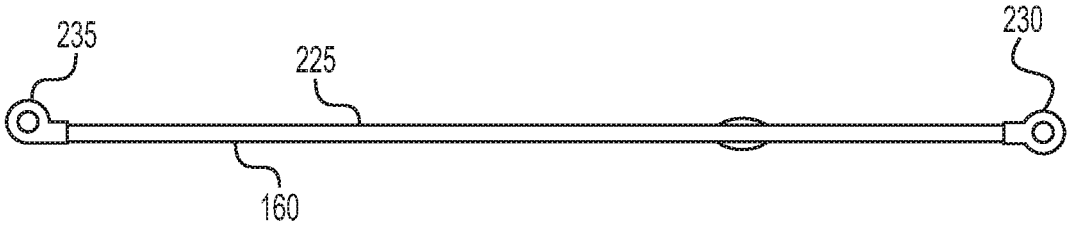
FIG. 5 is a side view of an interior stretcher of an interior stretcher frame of the umbrella in one embodiment of the present invention.
Figure 6:
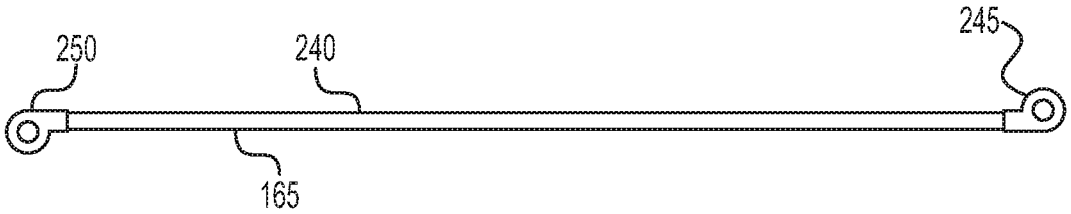
FIG. 6 is a side view of an exterior stretcher of an exterior stretcher frame of the umbrella in one embodiment of the present invention.

As shown in FIG. 5, each interior stretcher 160 includes a pole 225, with an interior proximal connector 230 attached to one end, and an interior distal connector 235 attached to another end. As shown in FIG. 6, each exterior stretcher 165 includes a pole 240, with an exterior proximal connector 245 attached to one end, and an exterior distal connector 250 attached to another end.

Figure 7:
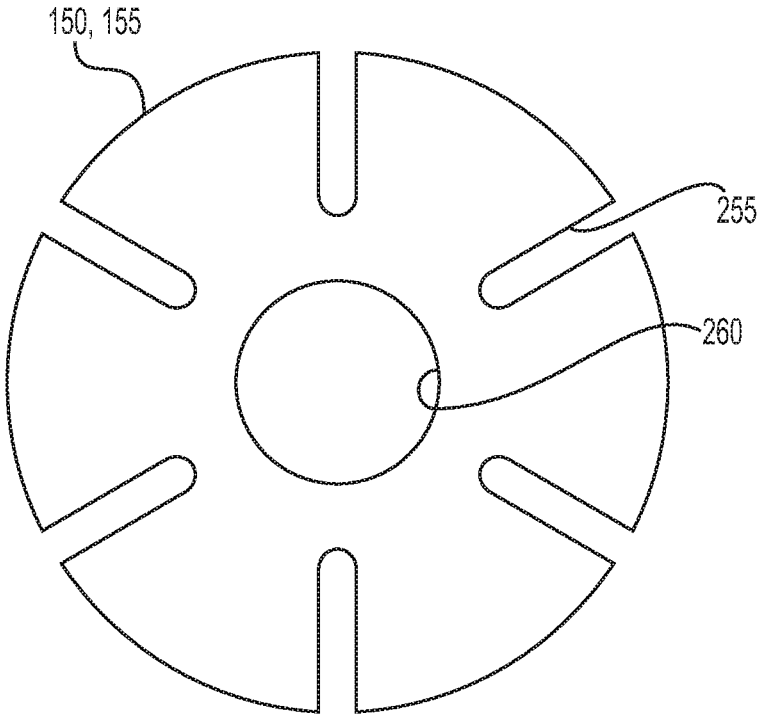
FIG. 7 is a top view of a hub included in the interior stretcher frame and in the exterior stretcher frame of the umbrella in one embodiment of the present invention.
Figure 8:
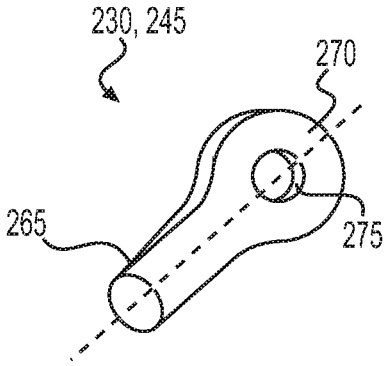
FIG. 8 is an isometric view of a proximal connector of a connector assembly of the umbrella in one embodiment of the present invention.

The interior hub 150 and the exterior hub 155 have substantially the same structure. Therefore, the description below applies to both the interior hub and the exterior hub. As shown in FIG. 7, the hub 150, 155 has a generally circular shape, with slots 255 formed in a periphery. Although six slots 255 are provided on the hub 150, 155, as shown in FIG. 7, the invention is not limited to this number of slots 255. Preferably, the number of slots 255 on the interior hub 150 corresponds to the number of interior stretchers 160, and the number of slots 255 on the exterior hub 155 corresponds to the number of exterior stretchers 165. The hub 150, 155 also includes a central through-hole 260, as shown in FIGS. 7 and 8, for mounting the hub 150, 155 to the shaft 105. As noted above, the interior hub 150 is fixed near the upper end 135 of the shaft 105, and the exterior hub 155 is movable along the shaft 105. In this embodiment, the exterior hub 155 is connected to the rod 215 using and insert lock pin (not shown) and the exterior hub 155 is moved by the rod 215.

The interior proximal connector 230 and the exterior proximal connector 245 have substantially the same structure. Therefore, the description below applies to both the interior proximal connector and the exterior proximal connector. As shown in FIG. 8, the proximal connector 230, 245 has a cylindrical portion 265 that attaches to the pole 225 of the interior stretcher 160, and a tab portion 270 that attaches to the hub 150, 155. The tab portion 270 is substantially centered on an axis of the cylindrical portion 265, as shown in FIG. 8. The tab portion 270 includes a hole 275 that is used to secure the proximal connector 230, 245 to the hub 150, 155. The tab portion 270 is inserted into the slots 255 on the hub 150, 155, and the proximal connectors 230, 245 are rotatable relative to the hub 150, 155. In this embodiment, a steel wire ring (not shown) is inserted through the hole 275 in each proximal connector 230, 245 and the hub 150, 155 to secure the proximal connectors 230, 245 to the hub 150, 155. In a preferred embodiment, the number of interior stretchers 160 corresponds to the number of slots 255 on the interior hub 150, and the number of exterior stretchers 165 corresponds to the number of slots 255 on the exterior hub 155. In the embodiment shown in FIG. 1, six interior stretchers 160 and six exterior stretchers 165 are provided, as noted above, and the interior hub 150 and the exterior hub 155 each include six slots 255. The invention is not limited, however, by the number of interior stretchers 160 or the number of exterior stretchers 165, or by the number of slots 255.

Figure 9:
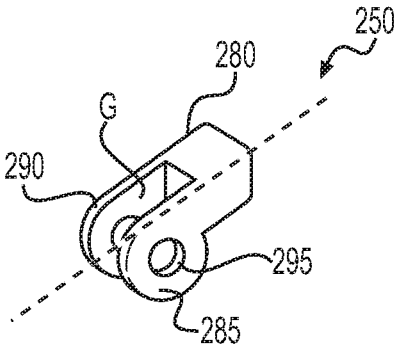
FIG. 9 is an isometric view of an exterior distal connector of the connector assembly of the umbrella in one embodiment of the present invention.

The distal connector 250 attached to the exterior stretcher 165 (or the exterior distal connector 250) is shown in more detail in FIG. 9. The exterior distal connector 250 includes a cylindrical portion 280 that is attached to the end of the pole 240 of the exterior stretcher 165, and a first tab portion 285 and a second tab portion 290. Any suitable method may be used to connect the cylindrical portion 280 to the end of the pole 240, but in this embodiment a steel insert lock pin (not shown) is used. Each of the first tab portion 285 and the second tab portion 290 includes a hole 295 in a center. The first tab portion 285 and the second tab portion 290 are spaced apart from each other, so as to form a gap G. The first tab portion 285 and the second tab portion 290 extend toward one side of an axis of the cylindrical portion 280, as shown in FIG. 9. The cylindrical portion 280, the first tab portion 285, and the second tab portion 290 are formed integrally. Preferably, the exterior distal connector 250 is formed of metal.

Figure 10:
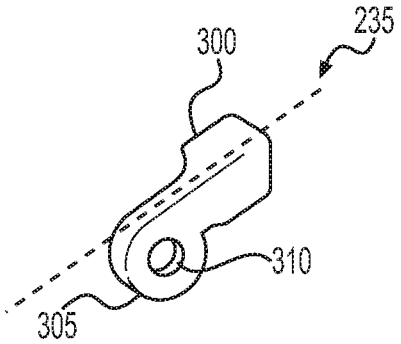
FIG. 10 is an isometric view of an interior distal connector of the connector assembly of the umbrella in one embodiment of the present invention.

The distal connector 235 attached to the interior stretcher 160 (or the interior distal connector 235) is shown in more detail in FIG. 10. The interior distal connector 235 includes a cylindrical portion 300 that is attached to the end of the pole 225 of the interior stretcher 160, and a tab portion 305. Any suitable method may be used to connect the cylindrical portion 300 to the end of the pole 225, but in this embodiment a steel insert lock pin (not shown) is used. The tab portion 305 includes a hole 310 in a center. The tab portion 305 extends toward one side of an axis of the cylindrical portion 300, as shown in FIG. 10. The cylindrical portion 300 and the tab portion 305 are formed integrally. Preferably, the interior distal connector 235 is formed of metal.

Figure 11:
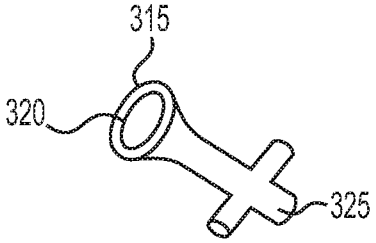
FIG. 11 is an isometric view of a rivet of the connector assembly of the umbrella in one embodiment of the present invention.

Each interior distal connector 235 provided on the ends of the poles 225 of the interior stretchers 160 is connected to a corresponding one of the exterior distal connectors 250 provided on the ends of the poles 240 of the exterior stretchers 165 by, for example, a tubular rivet 315. The distal connectors 235 and 250 and the rivets 315 form the connector assemblies 130. With reference to FIG. 11, each rivet 315 has a head 320 at one end, and a tail 325 at the other end.

To form each connector assembly, the hole 310 in the tab portion 305 of the interior distal connector 235 attached to the interior stretcher 160 is aligned with the holes 295 in the first tab portion 285 and the second tab portion 290 of the exterior distal connector 250 attached to the exterior stretcher 165. More specifically, the tab portion 305 of the interior distal connector 235 attached to the interior stretcher 160 is inserted in between the first tab portion 285 and the second tab portion 290 of the exterior distal connector 250 attached to the exterior stretcher 165, so that the holes 295 align with the hole 310. Then, the tail 325 of the rivet 315 is inserted through one of the holes 295 of the corresponding one of the first tab portion 285 and the second tab portion 290 of the exterior distal connector 250 attached to the exterior stretcher 165, through the hole 310 of the tab portion 305 of the interior distal connector 235 attached to the interior stretcher 160, and through the other one of the holes 295 of the corresponding one of the first tab portion 285 and the second tab portion 290 of the exterior distal connector 250 attached to the exterior stretcher 165. Then, the rivet 315 is bucked, or deformed, so as to secure the tab portions 285 and 290 of the exterior distal connector 250 and the tab portion 305 of the interior distal connector 235 together. The invention is not limited, however, to use of a rivet 315 to secure the tab portions 285 and 290 of the exterior distal connector 250 and the tab portion 305 of the interior distal connector 235. It is within the scope of the invention to use an alternative mechanical fastener to secure the tab portions 285 and 290 of the exterior distal connector 250 and the tab portion 305 of the interior distal connector 235 together.

When aligning the holes 295 and 310, the distal connectors 235 and 250 are arranged so that the side of the cylindrical portion 280 of the exterior distal connector 250 attached to the exterior stretcher 165, relative to which the first tab portion 285 and the second tab portion 290 protrude, faces the side of the cylindrical portion 300 of the interior distal connector 235 attached to the interior stretcher 160, relative to which the tab portion 305 protrudes. In this manner, the connector assemblies 130 form a space between the exterior distal connector 250 and the interior distal connector 235.

By forming the connector assemblies 130 in this manner, the connector assemblies 130 are rotatable about an axis of the rivet 315, allowing the interior stretcher frame 120 and the exterior stretcher frame 125 to open, thereby opening the umbrella 100, and to close, thereby closing the umbrella 100. That is, the interior distal connector 235 and the exterior distal connector 250 can rotate about the rivet 315, in order to allow the interior stretcher frame 120 and the exterior stretcher frame 125 to open and to close.

With reference to FIG. 1, the canopy 110 includes a central hole 330 (not shown) forming an inner edge 335 that is centrally mounted and secured to the upper end 135 of the shaft 105. The inner edge 335 of the canopy 110 is secured beneath the exterior hub 155. An outer edge 340 of the canopy 110 is secured between the each of the plurality of connector assemblies 130.

When the umbrella 100 is closed, the exterior hub 155 is relatively lower in position along the shaft 105, and each of the interior stretcher frame 120, the exterior stretcher frame 125, and the canopy 110 are folded inward. The hook 200 of the opening and closing mechanism 115 holds the runner 195 and, therefore, the rod 215, in a lower position along the shaft 105. In addition, the user may use the strap 175 to secure the interior stretchers 160, the exterior stretchers 165, and the canopy 110 to the shaft 105.

When the user presses the button 205, the hook 200 moves to the retracted position, and the spring 220 forces the rod 215 and the runner 195 upward along the shaft 105. As the rod 215 moves upward, the interior proximal connectors 230 and the exterior proximal connectors 245 rotate within the interior hub 150 and the exterior hub, respectively, causing the distal ends of the interior stretchers 160 and the exterior stretchers 165 to rotate away from the shaft 105. The flexibility of the interior stretchers 160 and the exterior stretchers 165 enables the interior stretcher frame 120 and the exterior stretcher frame 125, respectively, to bend. As the interior stretcher frame 120 and the exterior stretcher frame 125 bend, the connector assemblies 130 retain the outer edge 340 of the canopy 110, thereby stretching the canopy 110 into the dome-like shape. More specifically, due to the relative lengths of the interior stretchers 160 and the exterior stretchers 165, when the interior stretcher frame 120 and the exterior stretcher frame 125 unfold, or open, and, therefore, the canopy 110 unfolds, or opens, the canopy 110 forms the dome-like shape, with the exterior stretcher frame 125 being on an outer side of the dome-shaped canopy 110, and the interior stretcher frame 120 being on an inner side of the dome-shaped canopy 110, as shown in FIGS. 1 and 4. The canopy 110 may be locked in the open, dome-like shape by using a locking mechanism with the runner 195 or the interior hub 150. In such case, any suitable locking mechanism known in the art may be used including, for example, a triangular shape catch that engages with a groove formed in the runner 195 or the interior hub 150.

The combination of the interior stretcher frame 120 and the exterior stretcher frame 125 has been found to be particularly useful in preventing the umbrella 100 from inverting, i.e., turning inside out. Put another way, the connector assemblies 130 remain in a lower position relative to the interior hub 150 along the longitudinal axis A-A, and, therefore, the umbrella 100 will not invert.

While the invention has been described with respect to what is, at present, considered to be the preferred embodiment, it is to be understood that the invention is not limited to the disclosed embodiments. To the contrary, the invention is intended to cover various modifications and equivalent arrangements included within the spirit and the scope of the appended claims.

What is claimed is:

1. An umbrella comprising:

a shaft having an upper end and a lower end that define a longitudinal shaft axis;

a canopy having an inner edge centrally mounted to the upper end of the shaft, and an outer edge;

an opening and closing mechanism provided between the upper end and the lower end of the shaft, the opening and closing mechanism configured to move the canopy between an open state and a closed state;

an inner stretcher frame having:

an inner hub centrally mounted to the shaft on an inner side of the canopy; and a plurality of inner stretchers, each of the plurality of inner stretchers provided on the inner side of the canopy and having a terminal end that is rotatably connected to the inner hub, and a distal end;

an outer stretcher frame having:

an outer hub centrally mounted to the shaft on an outer side of the canopy; and a plurality of outer stretchers, each of the plurality of outer stretchers provided on the outer side of the canopy and having a terminal end that is rotatably connected to the outer hub, and a distal end; and a plurality of connector assemblies rotatably connecting the distal end of each of the plurality of inner stretchers to the distal end of a corresponding one of the plurality of outer stretchers, and retaining the outer edge of the canopy, wherein the shaft includes a longitudinal slot provided between the upper end and the lower end of the shaft, and wherein the opening and closing mechanism includes a runner mounted to the shaft, the runner having an inner portion nested within the shaft, and an outer portion with a rim on a lower end, and being configured to slide along the shaft.

2. The umbrella according to claim 1, wherein the shaft includes a hook hole provided below the longitudinal slot near the lower end of the shaft, wherein the opening and closing mechanism includes:

a hook configured to protrude from the hook hole, and having a protrusion configured to catch the rim of the outer portion of the runner to prevent the runner from sliding along the shaft; and a button connected to the hook, and wherein the hook is biased to protrude from the hook hole, and, when the user pushes the button inward, the hook retracts within the hook hole, and releases the rim of the outer portion of the runner.

3. An umbrella comprising:

a shaft having an upper end and a lower end that define a longitudinal shaft axis;

a canopy having an inner edge centrally mounted to the upper end of the shaft, and an outer edge;

an opening and closing mechanism provided between the upper end and the lower end of the shaft, the opening and closing mechanism configured to move the canopy between an open state and a closed state;

an inner stretcher frame having:

an inner hub centrally mounted to the shaft on an inner side of the canopy; and a plurality of inner stretchers, each of the plurality of inner stretchers provided on the inner side of the canopy and having a terminal end that is rotatably connected to the inner hub, and a distal end;

an outer stretcher frame having:

an outer hub centrally mounted to the shaft on an outer side of the canopy; and a plurality of outer stretchers, each of the plurality of outer stretchers provided on the outer side of the canopy and having a terminal end that is rotatably connected to the outer hub, and a distal end; and a plurality of connector assemblies rotatably connecting the distal end of each of the plurality of inner stretchers to the distal end of a corresponding one of the plurality of outer stretchers, and retaining the outer edge of the canopy, wherein each of the plurality of connector assemblies includes:

an interior distal connector having a cylindrical portion that is attached to an end of one of the plurality of interior stretchers, and a tab portion having a central through-hole and extending toward one side of an axis of the cylindrical portion of the interior distal connector;

an exterior distal connector having a cylindrical portion that is attached to one of the plurality of exterior stretchers, a first tab portion having a central through-hole, and a second tab portion having a central through-hole, the first tab portion and the second tab portion being spaced to form a gap therebetween, and the first tab portion and the second tab portion extending toward one side of an axis of the cylindrical portion of the exterior distal connector; and a rivet that extends through the central through-hole of the first tab portion of the exterior distal connector, the central through-hole of the tab portion of the interior distal connector, and the through-hole of the second tab portion of the exterior distal connector, the rivet being configured to secure the interior distal connector to the exterior distal connector.

4. A stretcher frame for stretching a canopy of an umbrella, the assembly comprising:

an inner stretcher frame having:

an inner hub centrally mountable to a shaft of the umbrella; and a plurality of inner stretchers, each of the plurality of inner stretchers provided on an inner side of the canopy and having a terminal end that is rotatably connected to the inner hub, and a distal end;

an outer stretcher frame having:

an outer hub centrally mountable to the shaft; and a plurality of outer stretchers, each of the plurality of outer stretchers provided on an outer side of the canopy and having a terminal end that is rotatably connected to the outer hub, and a distal end; and a plurality of connector assemblies rotatably connecting the distal end of each of the plurality of inner stretchers to the distal end of a corresponding one of the plurality of outer stretchers, and configured to retain an outer edge of the canopy, wherein each of the plurality of connector assemblies includes:

an interior distal connector having a cylindrical portion that is attached to an end of one of the plurality of interior stretchers, and a tab portion having a central through-hole and extending toward one side of an axis of the cylindrical portion of the interior distal connector;

an exterior distal connector having a cylindrical portion that is attached to one of the plurality of exterior stretchers, a first tab portion having a central through-hole, and a second tab portion having a central through-hole, the first tab portion and the second tab portion being spaced to form a gap therebetween, and the first tab portion and the second tab portion extending toward one side of an axis of the cylindrical portion of the exterior distal connector; and a rivet that extends through the central through-hole of the first tab portion of the exterior distal connector, the central through-hole of the tab portion of the interior distal connector, and the through-hole of the second tab portion of the exterior distal connector, the rivet being configured to secure the interior distal connector to the exterior distal connector.

5. An umbrella comprising:

a shaft;

an opening and closing mechanism connected to the shaft;

an interior stretcher frame assembly connected to the shaft and having a plurality of interior stretchers;

an exterior stretcher frame assembly connected to the shaft and having a plurality of exterior stretchers; and a canopy connected to the interior stretcher frame assembly and the exterior stretcher frame assembly, wherein each of the plurality of interior stretchers is provided on an interior side of the canopy, and each of the plurality of exterior stretchers is provided on an exterior side of the canopy, wherein, when the opening and closing mechanism opens, the interior stretcher frame assembly and the exterior stretcher frame assembly expand outward from the shaft, thereby opening the canopy, and, when the opening and closing mechanism closes, the interior stretcher frame assembly and the exterior stretcher frame assembly retract inward toward the shaft, thereby closing the canopy, wherein the shaft includes a longitudinal slot provided between the upper end and the lower end of the shaft, and wherein the opening and closing mechanism includes a runner mounted to the shaft, the runner having an inner portion nested within the shaft, and an outer portion with a rim on a lower end, and being configured to slide along the shaft.

6. An umbrella comprising:

a shaft;

an opening and closing mechanism connected to the shaft;

an interior stretcher frame assembly connected to the shaft and having a plurality of interior stretchers;

an exterior stretcher frame assembly connected to the shaft and having a plurality of exterior stretchers;

a plurality of connector assemblies that connect the interior stretcher frame assembly to the exterior stretcher frame assembly; and a canopy connected to the interior stretcher frame assembly and the exterior stretcher frame assembly, wherein each of the plurality of interior stretchers is provided on an interior side of the canopy, and each of the plurality of exterior stretchers is provided on an exterior side of the canopy, wherein, when the opening and closing mechanism opens, the interior stretcher frame assembly and the exterior stretcher frame assembly expand outward from the shaft, thereby opening the canopy, and, when the opening and closing mechanism closes, the interior stretcher frame assembly and the exterior stretcher frame assembly retract inward toward the shaft, thereby closing the canopy, and wherein each of the plurality of connector assemblies includes:

an interior distal connector having a cylindrical portion that is attached to an end of one of the plurality of interior stretchers, and a tab portion having a central through-hole and extending toward one side of an axis of the cylindrical portion of the interior distal connector;

an exterior distal connector having a cylindrical portion that is attached to one of the plurality of exterior stretchers, a first tab portion having a central through-hole, and a second tab portion having a central through-hole, the first tab portion and the second tab portion being spaced to form a gap therebetween, and the first tab portion and the second tab portion extending toward one side of an axis of the cylindrical portion of the exterior distal connector; and a rivet that extends through the central through-hole of the first tab portion of the exterior distal connector, the central through-hole of the tab portion of the interior distal connector, and the through-hole of the second tab portion of the exterior distal connector, the rivet being configured to secure the interior distal connector to the exterior distal connector.

* * * * *